US010015576B1

(12) United States Patent
Mungin et al.

(10) Patent No.: US 10,015,576 B1
(45) Date of Patent: Jul. 3, 2018

(54) HEADPHONES WITH COORDINATED EXTERNAL ILLUMINATION

(71) Applicants: Keith Mungin, Philadelphia, PA (US); Khalee King, Philadelphia, PA (US)

(72) Inventors: Keith Mungin, Philadelphia, PA (US); Khalee King, Philadelphia, PA (US)

( * ) Notice: Subject to any disclaimer, the term of this patent is extended or adjusted under 35 U.S.C. 154(b) by 0 days.

(21) Appl. No.: 15/810,094

(22) Filed: Nov. 12, 2017

(51) Int. Cl.
*H04R 1/10* (2006.01)
*F21V 33/00* (2006.01)
*F21W 111/00* (2006.01)

(52) U.S. Cl.
CPC ..... *H04R 1/1008* (2013.01); *F21V 33/0056* (2013.01); *H04R 1/1091* (2013.01); *F21W 2111/00* (2013.01); *H04R 2420/07* (2013.01)

(58) Field of Classification Search
CPC ..... H04R 1/10
See application file for complete search history.

(56) References Cited

U.S. PATENT DOCUMENTS

2007/0047740 A1* 3/2007 Andrea ..... H04R 1/1041 381/74
2012/0140973 A1* 6/2012 Olodort ..... H04R 1/1066 381/375
2014/0341415 A1* 11/2014 Camello ..... H04R 1/10 381/379
2015/0071456 A1* 3/2015 Steenkamp ..... H04R 1/1008 381/74
2015/0201268 A1* 7/2015 Chang ..... H04R 5/033 381/378
2015/0334485 A1* 11/2015 Tyagi ..... H01B 11/22 381/74
2016/0006847 A1* 1/2016 Usher ..... H04M 1/22 455/569.1

* cited by examiner

*Primary Examiner* — Olisa Anwah
(74) *Attorney, Agent, or Firm* — John D Gugliotta

(57) ABSTRACT

A headphone device is provided having a pair of symmetrically formed and circumaural housing element each having an audio output speaker directed from and inner surface and an illumination element incorporated in an outer surface. The illumination element has a lens that is illuminated in a manner that the intensity of illumination is modulated rhythmically in relation to the rhythm generated by the speakers. Further, an illuminated indicia in the form of a icon such as a treble clef or music note may be illuminated in a manner that the intensity of illumination is modulated rhythmically in relation to the rhythm generated by the speakers. The instant abstract is neither intended to define the invention disclosed in this specification nor intended to limit the scope of the invention in any way.

19 Claims, 3 Drawing Sheets

HEADPHONES WITH COORDINATED EXTERNAL ILLUMINATION

RELATED APPLICATIONS

There are no previously filed, nor currently any co-pending applications, anywhere in the world.

BACKGROUND OF THE INVENTION

1. Field of the Invention

The present invention relates generally to audio headphone systems and, more specifically, to an audio headphone that includes illuminated external indica.

2. Description of the Related Art

Audio headphones are a pair of small loudspeaker drivers that are designed to be worn on or around the head over a user's ears. They are electroacoustic transducers, which convert an electrical signal to a corresponding sound in the user's ear. Headphones are designed to allow a single user to listen to an audio source privately, in contrast to a loudspeaker, which emits sound into the open air, for anyone nearby to hear.

Improvements in headphones over the years have consisted primarily of improved audio output and changes in design choice and form factor, with a dearth of improvements directed toward adding additional functionality.

One series of improvements in functionality have recently been developed by Phaz Music Corp of New Jersey, in which the headphones are adapted with a means for sharing power for recharging devices. For example, U.S. Pat. No. 9,276,639 describes such a device that relates to headphones which can facilitate the transfer of electrical power from the headphones' internal power source to other devices. A pair of headphones can connect to a device through a modified cable. The modified cable triggers the transfer of electrical power to the device. A pair headphones may have a modified port which, when connected to the device through a non-modified or regular cable, causes the transfer of power from the headphones. A power management component connected to the internal power source of the headphones helps control or regulate the transfer of power transfer to and from the headphones.

Consequently, a need still exists for improvements in headphones which add additional non-audio functionalities.

SUMMARY OF THE INVENTION

It is thus an object of the present invention to provide improved audio headphones that includes illuminated external indica.

It is a feature of the present invention to provide such an illuminated indicia that provides a modulated illumination output that is generally synchronized to the audio content.

The present invention provide a headphone device in which a pair of audio housings are attached to opposing ends of an arcuately shaped retention band. Each audio housing is symmetrically formed and circumaural housing element having annular shaped earpad covering an inner surface in a manner adapted to provide a seal against a user's head and around the auditory meatus and auricle of a users's ear. An audio output speaker directs from the inner surface and is circumscribed by said earpad. An illumination element is incorporated in an outer surface. According to one aspect of the present inventing, the illumination comprises a lens, with the illumination element illuminating the said lens in a manner that an intensity of illumination is modulated in a manner that is rhythmically related to a rhythm generated by the speaker. According to another aspect of the present invention, the illumination element further comprises a lens and an illumination indicia formed on or in the lense, with the illumination indicia illuminating in a manner that an intensity of illumination is modulated in a manner that is rhythmically related to a rhythm generated by the speakers. It is further envisioned that the illumination indicia may be in the form of a musically related icon such as a treble clef or music note.

Further objects, features, elements and advantages of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
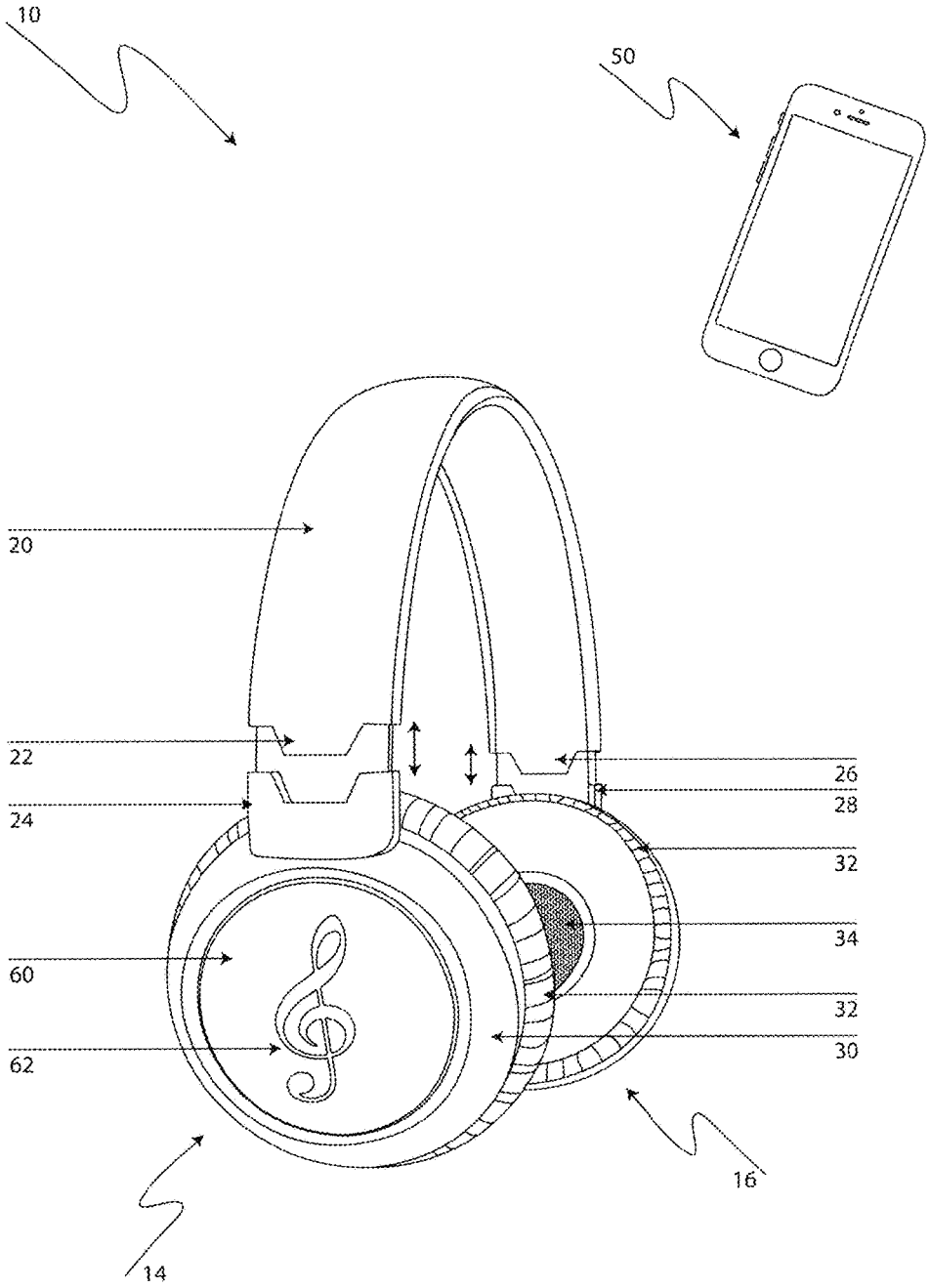
FIG. 1 is a side perspective view of an improved audio headphone system according to the preferred embodiment of the present invention.
Figure 2:
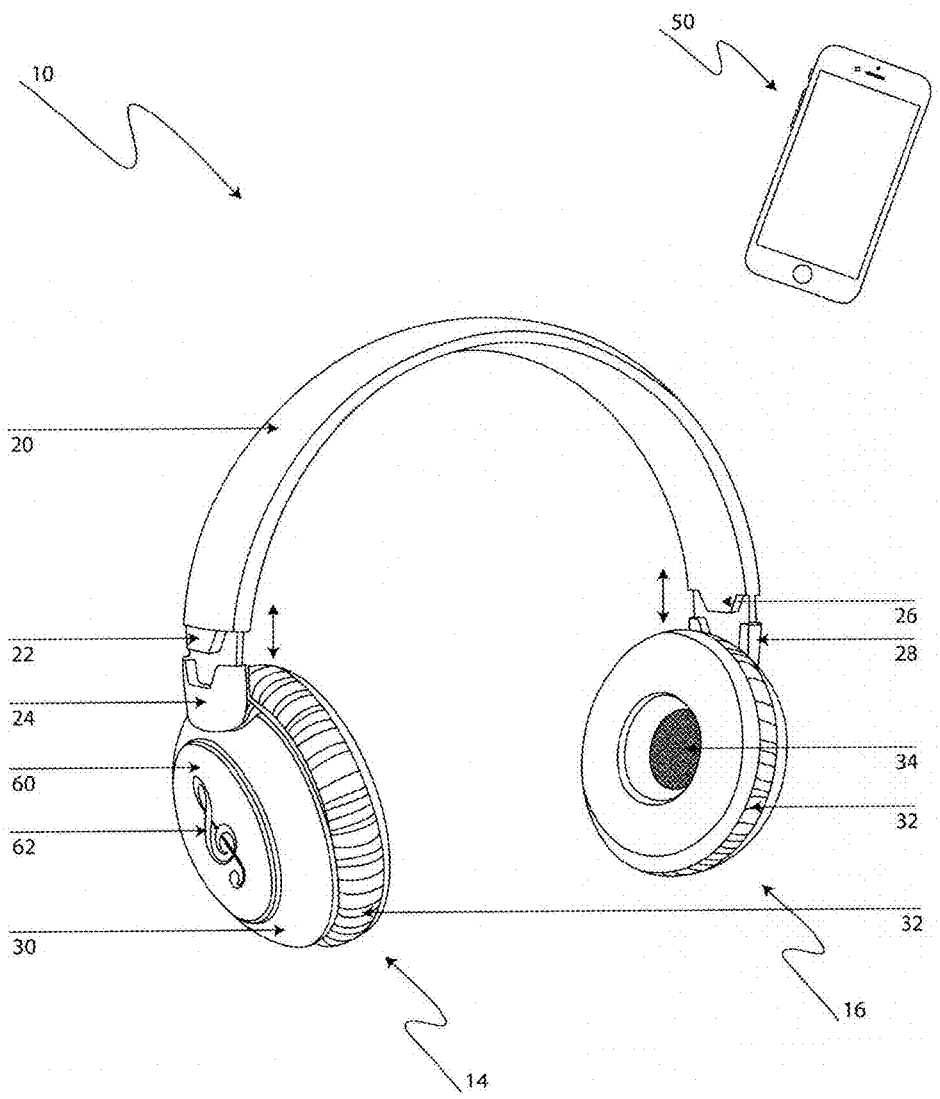
FIG. 2 is a front perspective view thereof.
Figure 3:
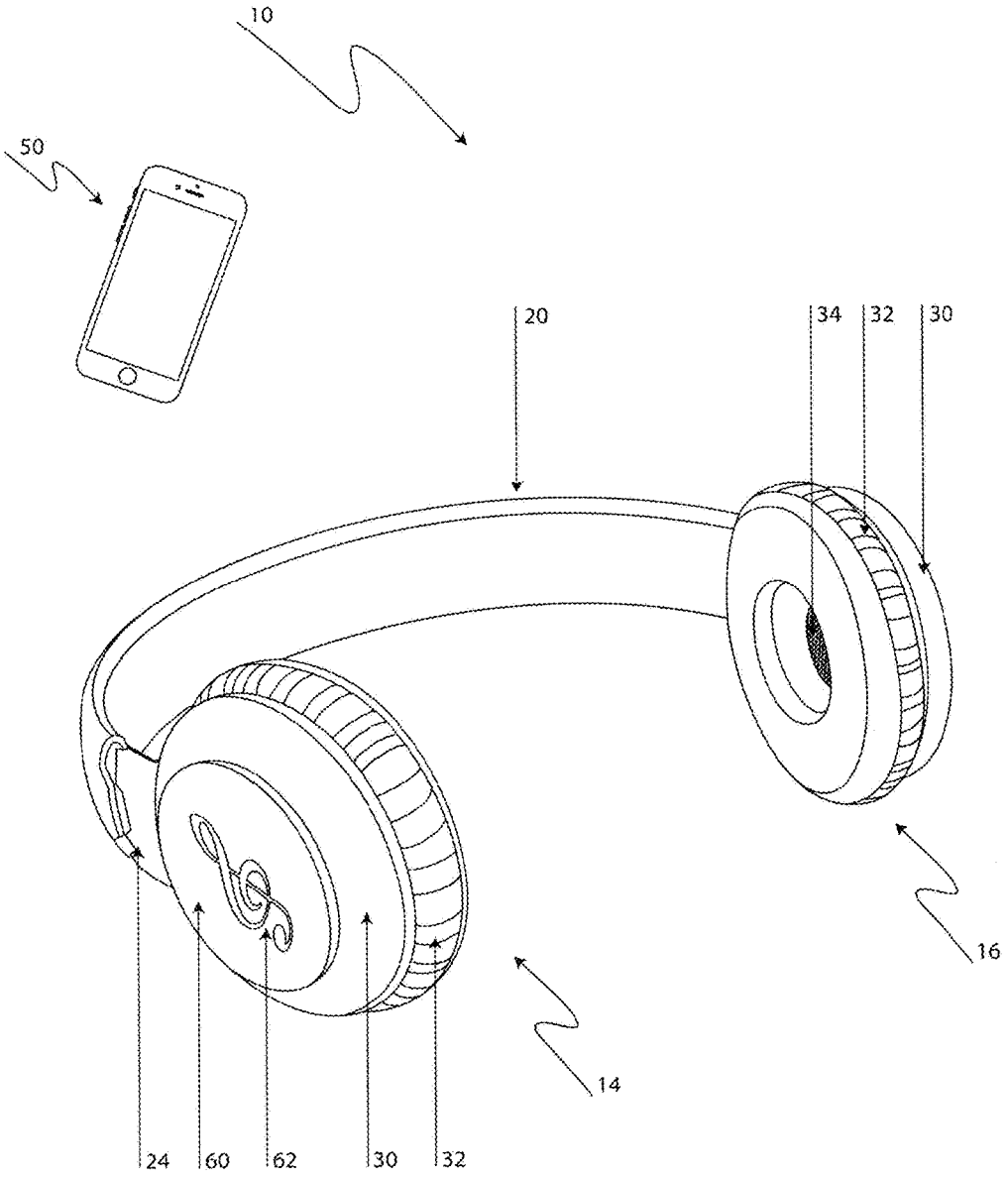
FIG. 3 is a bottom perspective view thereof.

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

The best mode for carrying out the invention is presented in terms of its preferred embodiment, herein depicted within the Figures.

1. Detailed Description of the Figures

Referring now to the drawings, wherein like reference numerals indicate the same parts throughout the several views, a headphone system, generally noted as 10, is shown according to the preferred embodiment of the present invention. The drawing figures are not necessarily drawn to scale and certain figures may be shown in exaggerated or generalized form in the interest of clarity and conciseness. The headphones 10 have a retention band 12 supporting a first audio can 14 opposite a second audio can 16, The retention band 12 is arcuately shaped and provides a spring bias adapted to facilitate placement over and retention on a user's head. The band 12 may further be circumscribed with a cushioning material 20 for comfort. Terminating at a first connection end 22 is a hinged attachment 24 for connection to the first audio can 14. Terminating at a second connection end 26 is a hinged attachment 28 for connection to the second audio can 28. Each connection end 24, 28 may be telescopingly adjustable with its respective connection end.

Each audio can 14, 16 may be of similar construction. By way of example, the first can 14 may form a circumaural housing 30 having supporting an earpad 32. The earpad 32 is intended to cover an interior surface of the housing 30 to provide a comfortable seal against a user's head and around the auditory meatus and auricle of a users's ear. The earpad 32 may further be generally annular in shape (i.e. circular, elipsisoidal, etc.) and circumscribing an audio output speaker 34.

The second can 16 may have a similar and symmetrical construction.

The headphones 10 are adapted for connection to an external device 50, and may further incorporate a number of features or improvement to facilitate the transmission of audio communication to the speakers 34. Headphones 10 may also include a port (not shown) for facilitating the connection with the external audio device, for example, such as an electrical cable. According to another aspect of the present invention, the headphones 10 may be in wireless connection with the external audio device, such as through Bluetooth™ communication.

Finally, according to one aspect of the present invention the first can 14 is provided with an lens 60 formed out the outer surface of the housing 30. The lens 60 provides an illumination element 62. While it is envisioned that the entire lense 60 may be illuminated, it is further intended that alternately an illuminated external indica 64 can be provided within the lens 60 wherein only the indicia 64 is illuminated. According to an alternate aspect of the present invention, both the first can 14 and second can 16 are provided with lens 60, illumination element 62, or illuminated external indica 64. In each aspect, the illumination element 62 or illuminated external indicia 14 provide illumination in a manner that is synchronized with the audio output of the speakers 34.

Further is should be apparent to those having ordinary skill in the relevant art, in light of the present teachings, that additional objects, features, elements and advantages of the invention may become apparent in light of the following operation of the invention.

2. Operation of the Preferred Embodiment

In operation, the headphones 10 are donned over a user's head such that the first can 14 circumferentially encases one ear and the second can 16 circumferentially encases the other ear. The audio device is then operationally connected to provide audio output through the speakers 34. As the audio output is generated, the illumination elements 62 is illuminated, with the intensity of illumination being modulated in a manner that is rhythmically related to a rhythm that is being generated by the speakers 34. This may include such modulated illumination on one side or on both sides of the headphones. Further, this illumination modulation may further be provided only by the illuminated external indica 64, and further still occurring on one side or both sides of the headphones. While the limitation of a style or design of any particular indicia 64 should not be considered limiting, one intended design may include an image of a treble clef, in that such a symbol is generally identified as indicating music. In this manner, when in operation a modulating, illuminated treble clef may be provided while the user is listening to music, thereby providing anyone around an immediate visual impression that the user is listening to music.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

Having thus described the invention what is claimed as new and desired to be secured by Letters Patent is as follows:

1. A headphone device comprising:

a retention band forming an arcuately shaped spring adapted to facilitate placement over and retention on a user's head, said band having a first connection end opposite a second connection end;

a first audio housing attached to said first connection end, said first audio housing further comprising;

a first circumaural housing element having an inner surface opposite an outer surface;

a generally annular shaped first earpad covering said an inner in a manner adapted to provide a seal against a user's head and around the auditory meatus and auricle of a users's ear;

a first audio output speaker directed from said inner surface and circumscribed by said earpad; and a first illumination element incorporated in said outer surface, wherein said first illumination element further comprises:

a first lens; and a first illumination indicia formed on or in said lens; wherein said illumination indicia illuminates in a manner that an intensity of illumination is modulated in a manner that is rhythmically related to a rhythm generated by the first speaker; and a second audio housing attached to said second connection end, said second audio housing further comprising;

a second circumaural housing element having an inner surface opposite an outer surface;

a generally annular shaped second earpad covering said an inner in a manner adapted to provide a seal against a user's head and around the auditory meatus and auricle of a users's ear;

a second audio output speaker directed from said inner surface and circumscribed by said earpad, wherein said headphone is further are adapted for connection to an external audio player device for transmission of audio communication to the speakers.

2. The headphone device of claim 1, wherein said illumination element further comprises a lens and wherein said illumination element illuminates said lens in a manner that an intensity of illumination is modulated in a manner that is rhythmically related to a rhythm generated by the first speaker.

3. The headphone device of claim 1, wherein said second audio housing further comprises:

a second illumination element incorporated in said outer surface.

4. The headphone device of claim 3, wherein said second illumination element further comprises a lens and wherein said illumination element illuminates said lens in a manner that an intensity of illumination is modulated in a manner that is rhythmically related to a rhythm generated by the second speaker.

5. The headphone device of claim 4, wherein said first connection end and said second connection end are each telescopingly adjustable.

6. The headphone device of claim 4, wherein said retention band is circumscribed with a cushioning material.

7. The headphone device of claim 4, wherein said connection to an external audio player device comprises a wireless connection.

8. The headphone device of claim 7, wherein said wireless connection comprises Bluetooth™ communication.

9. The headphone device of claim 1, wherein said illumination indicia comprises a musically related icon.

10. The headphone device of claim 3, wherein said second illumination element further comprises:

a second lens; and a second illumination indicia formed on or in said lens;

wherein said second illumination indicia illuminates in a manner that an intensity of illumination is modulated in a manner that is rhythmically related to a rhythm generated by the second speaker.

11. The headphone device of claim 10, wherein said first connection end and said second connection end are each telescopingly adjustable.

12. The headphone device of claim 10, wherein said retention band is circumscribed with a cushioning material.

13. The headphone device of claim 10, wherein said connection to an external audio player device comprises a wireless connection.

14. The headphone device of claim 13, wherein said wireless connection comprises Bluetooth™ communication.

15. A headphone device comprising:

a retention band forming an arcuately shaped spring adapted to facilitate placement over and retention on a user's head, said band having a first connection end opposite a second connection end;

a first audio housing attached to said first connection end, said first audio housing further comprising;

a first circumaural housing element having an inner surface opposite an outer surface;

a generally annular shaped first earpad covering said an inner in a manner adapted to provide a seal against a user's head and around the auditory meatus and auricle of a users's ear;

a first audio output speaker directed from said inner surface and circumscribed by said earpad; and a first illumination element incorporated in said outer surface, wherein said first illumination element further comprises a lens and wherein said illumination element illuminates said lens in a manner that an intensity of illumination is modulated in a manner that is rhythmically related to a rhythm generated by the first speaker; and a second audio housing attached to said second connection end, said second audio housing further comprising;

a second circumaural housing element having an inner surface opposite an outer surface;

a generally annular shaped second earpad covering said an inner in a manner adapted to provide a seal against a user's head and around the auditory meatus and auricle of a users's ear;

a second audio output speaker directed from said inner surface and circumscribed by said earpad; and a second illumination element incorporated in said outer surface, wherein said second illumination element further comprises a lens and wherein said illumination element illuminates said lens in a manner that an intensity of illumination is modulated in a manner that is rhythmically related to a rhythm generated by the second speaker; and wherein said headphone is further are adapted for connection to an external audio player device for transmission of audio communication to the speakers.

16. The headphone device of claim 14, wherein said first connection end and said second connection end are each telescopingly adjustable;

said retention band is circumscribed with a cushioning material; and said connection to an external audio player device comprises a wireless connection.

17. The headphone device of claim 16, wherein said wireless connection comprises Bluetooth™ communication.

18. A headphone device comprising:

a retention band forming an arcuately shaped spring adapted to facilitate placement over and retention on a user's head, said band having a first connection end opposite a second connection end;

a first audio housing attached to said first connection end, said first audio housing further comprising;

a first circumaural housing element having an inner surface opposite an outer surface;

a generally annular shaped first earpad covering said an inner in a manner adapted to provide a seal against a user's head and around the auditory meatus and auricle of a users's ear;

a first audio output speaker directed from said inner surface and circumscribed by said earpad; and a first illumination element further comprising a first lens and a first illumination indicia formed on or in said lens, wherein said illumination indicia illuminates in a manner that an intensity of illumination is modulated in a manner that is rhythmically related to a rhythm generated by the first speaker; and a second audio housing attached to said second connection end, said second audio housing further comprising;

a second circumaural housing element having an inner surface opposite an outer surface;

a generally annular shaped second earpad covering said an inner in a manner adapted to provide a seal against a user's head and around the auditory meatus and auricle of a users's ear;

a second audio output speaker directed from said inner surface and circumscribed by said earpad; and a second illumination element further comprising a second lens and a second illumination indicia formed on or in said second lens, wherein said second illumination indicia illuminates in a manner that an intensity of illumination is modulated in a manner that is rhythmically related to a rhythm generated by the second speaker;

wherein said headphone is further are adapted for connection to an external audio player device for transmission of audio communication to the speakers.

19. The headphone device of claim 18, wherein said first connection end and said second connection end are each telescopingly adjustable;

said retention band is circumscribed with a cushioning material; and said connection to an external audio player device comprises a Bluetooth™ wireless communication connection.

* * * * *